US005281940A

United States Patent [19]

Goto

[11] Patent Number: 5,281,940

[45] Date of Patent: Jan. 25, 1994

[54] SOLENOID COIL BOBBIN FOR ELECTROMAGNETIC SWITCH

[75] Inventor: Takeo Goto, Hyogo, Japan

[73] Assignee: Mitsubishi Denki K.K., Tokyo, Japan

[21] Appl. No.: 860,034

[22] Filed: Mar. 30, 1992

[30] Foreign Application Priority Data

Apr. 15, 1991 [JP] Japan ..... 3-34272[U]

[51] Int. Cl.[5] ..... H01F 5/00; H01F 15/10; H01H 50/60

[52] U.S. Cl. ..... 335/282; 335/131; 336/192

[58] Field of Search ..... 335/131, 282; 336/192; 361/428; 174/65 R

[56] References Cited

U.S. PATENT DOCUMENTS 4,677,407 6/1987 Tanaka et al. .

FOREIGN PATENT DOCUMENTS 63-8087 3/1988 Japan .

*Primary Examiner*—Harold Broome

*Attorney, Agent, or Firm*—Sughrue, Mion, Zinn Macpeak & Seas

[57] ABSTRACT

A solenoid coil bobbin of the present invention for an electromagnetic switch which has a lead wire part of a coil being provided with projections an outer circumference walls adjacent to a pair grooves to be included the lead wire in the opening therebetween, each top end of the projections further having a swollen portion which protrudes in some length from a shape of a hall of the rigid iron core to be inserted the lead wire part therein, so that the swollen portion closes the opening of the lead wire part when inserting the lead wire part in the hall.

3 Claims, 2 Drawing Sheets

SOLENOID COIL BOBBIN FOR ELECTROMAGNETIC SWITCH

BACKGROUND OF THE INVENTION

This invention relates to an solenoid coil bobbin for an electromagnetic switch of a starter, and specifically to an insulating construction of a lead wire portion.

A conventional electromagnetic switch of a starter is explained with respect to FIG. 3. An exciting coil 1 is wound around a bobbin 10. A rigid iron core 3 supports the bobbin 10. A case 2 holds the rigid iron core 3 as a yoke. A plunger 5 consisting of a magnetic material is held on the front inner surface of the case 2, slidable along the axial direction thereof, and is provided with a rod 6 at the rear end portion thereof as one body. A movable contact 7 is fixed to the rear end portion of the rod 6 in an insulated manner. A pair of fixed contacts 8 is positioned corresponding to the movable contact 7 in the axial direction. A hook 9 is held in the bore of the plunger 5 and is slidable along the axial direction. The front end portion of the hook is in contact with the top portion of a shift lever 9*a* so as to rotate the lever.

The operation of the conventional electromagnetic switch thus constructed will be described. When the exciting coil 1 is turned on, the plunger 5 is attracted to the rigid iron core 3, and the hook 9 is moved back. Further, the shift lever 9*a* is rotated so as to link a pinion of a rotating axis of an armature with a ring gear of an engine (not shown). Next, the movable contact 7 closes the pair of fixed contacts 8 so as to start to rotate the starter.

The exciting coil 1 is constructed from an outer coil 1*a* and an inner coil 1*b* wound around the bobbin 10 consisting of a synthetic resin (e.g. nylon reinforced by grass-fiber).

The conventional solenoid coil bobbin (Japanese Patent Publication No. sho. 63-8087) will be described with reference to FIG. 4*a*, and FIG. 4*b*.

The bobbin 10 is provided with a cylindrical part 12 and flanges 13 and 14 projecting toward the radial direction of the cylindrical part 12 at the both side ends of part 12 so as to define each edge wall of the bobbin. The flange 14 is provided with two notches 15 on the circumferential edge thereof as an inlet for wire passage when beginning to wind the coils 1*a* and 1*b*. Moreover, the flange 14 is provided with lead wire elements 18 having a cylindrical shape and projecting from an axial outer surface thereof, with circumferential walls 17 of the lead wire parts 18 provided with line openings 16 along the axial direction thereof and being connected with the notches 15, respectively.

The two lead wire elements 18 have the same structure. Namely, an axial partition 19 which has a narrow width than the line opening 16 is provided in the circumferential wall 17 and projects in the radial direction of the flange 14, so as to form circumferentially adjacent axial grooves 20*a* and 20*b*. Each of grooves 20*a* and 20*b* is open to the line opening 16 of the wall 17, and connected with one of the notches 15 of the flange 14.

The wall 17 of the lead wire part 18 is constructed from a large diameter part 17*a* on a side thereof toward flange 14 and a small diameter part 17*b* projecting in an axial outer direction from the large diameter part 17*a*. The difference between the large diameter part 17*a* and the small diameter part 17*b* is only the diameter, each width value of the grooves 20*a*, 20*b* and partition 19 is same in both of the parts 17*a* and 17*b*. The small diameter part 17*b* of the wall 17 is provided with a width slit 17*c* which connects the groove 20*a* with a circumferential surface of the small diameter part 17*b*. Moreover, a circumferential surface of the large diameter part 17*a* of the wall 17 is provided with projections 16*a* and 16*b* disposed on the edges of the line opening 16. The above-mentioned parts consist of synthetic resin as one body.

In the above mentioned bobbin, after winding the inner coil 1*b*, the outer coil 1*a* with its lead wire (not shown) is passed through the groove 20*a* (shallow side) wound around the inner coil 1*b*. After this, the projections 16*a* and 16*b* disposed along the edges of the line opening 16 of the lead wire part 18 are bent to the inside of the opening by heat softening so as to close the line opening 16. As a result of closing, the large diameter part 17*a* of the circumferential wall of the lead wire part 18 would not only have a surface without discontinuous portions, but also prevent escape of the lead wire from the grooves 20*a* and 20*b*. The constructed lead wire part 18 is inserted in a wall of the rigid iron core 3 of the electromagnetic starter 2 using the bobbin.

The above bobbin of the conventional electromagnetic switch has a problem in that the producing processes for providing the projections 16*a* and 16*b* on each edge of the grooves 20*a* and 20*b* are expensive and in that bending the projections 16*a* and 16*b* by heat softening increases the production period and expense.

SUMMARY OF THE INVENTION

An object of the present invention is to eliminate the above-described problem. More specifically, an object of the invention is to provide a solenoid coil bobbin for an electromagnetic switch for a starter which has a lead wire element of easy construction and simple structure.

The solenoid coil bobbin of the present invention has a lead wire an element provided with projections on outer and circumference thereof adjacent to a pair of grooves which hold the lead wires, each top end of the projections further having a swollen portion which protrudes some length and is urged by a shape of a wall of the rigid iron core, so that the swollen portion closes the opening of the lead wire element when inserted into the core wall.

In accordance with the present invention, when the lead wire part is inserted in the wall of the rigid iron coil, the projection on the outer circumferential wall is pushed toward the inside of the grooves so as to insulate between the coil winding and the rigid iron core.

BRIEF DESCRIPTION OF THE DRAWINGS

FIG. 1(*b*) is a sectional view taken on line A—A in FIG. 1(*a*);

FIG. 4(*b*) is a sectional view taken on line B - B in FIG. 4(*a*);

DETAILED DESCRIPTION OF THE INVENTION

One preferred embodiment of this invention will be described with reference to the accompanying drawings.

Figure 1A:
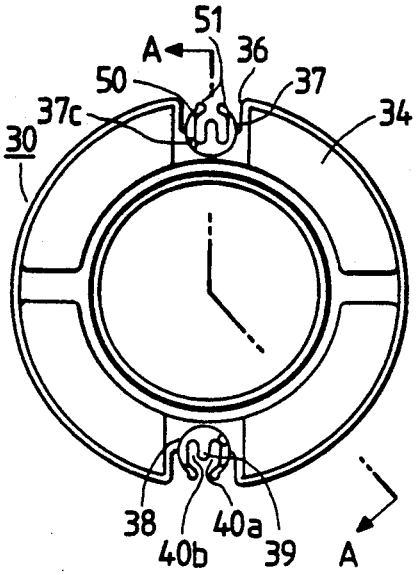
FIG. 1(*a*) is a right side view showing an example of a solenoid coil bobbin for an electromagnetic switch according to this invention.
Figure 1B:
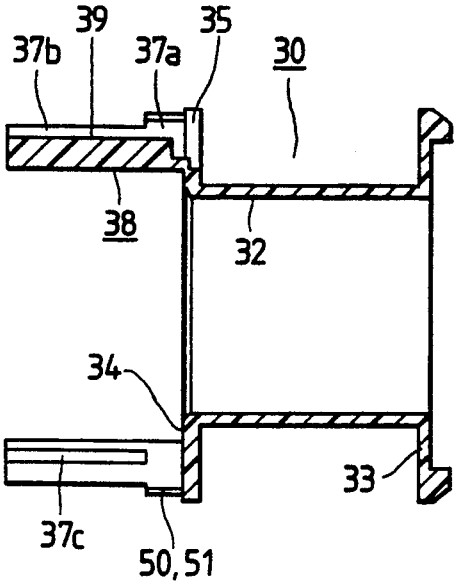

FIG. 1(*a*) is a sectional view showing an example of a solenoid coil bobbin for an electromagnetic switch according to this invention. FIG. 1(*b*) is a sectional view along line A - A in FIG. 1(*a*). The bobbin 30 is provided with a cylindrical part 32 and flanges 33 and 34 projecting in the radial direction of the cylindrical part at both sides of part 32. The flange 34 is provided with notches 35 on the circumferential edge thereof as an inlet for wire passage when beginning to wind the coils 1*a* and 1*b*. Moreover, the flange 34 is provided with lead wire elements 38 having a cylindrical shape and projecting from an axially outer surface thereof. Circumferential walls 37 of the lead wire elements 38 are provided with line openings 36 extending in the axial direction and connected with the notches 35, respectively.

The two lead wire elements 38 have the same structure. An axial partition 39 is provided in the wall 37 and projects radially, so as to form axial grooves 40*a* and 40*b* and this separate the inner space of the element circumferentially of the bobbin 10. The wall 37 of the lead wire element 38 consists of an inner part 37*a* on the flange 34 side and an outer part 37*b* projecting axially outwardly from the inner part 37*a*.

Figure 2:
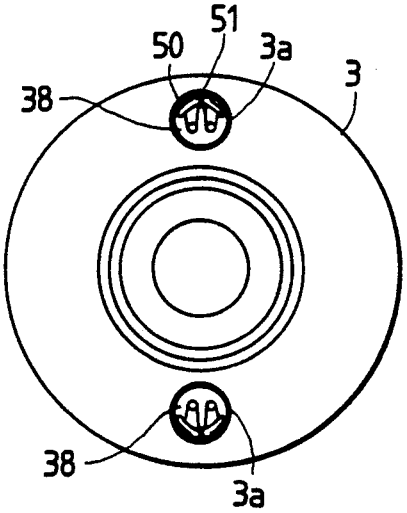
FIG. 2 is a side view showing details of the bobbin.
Figure 3:
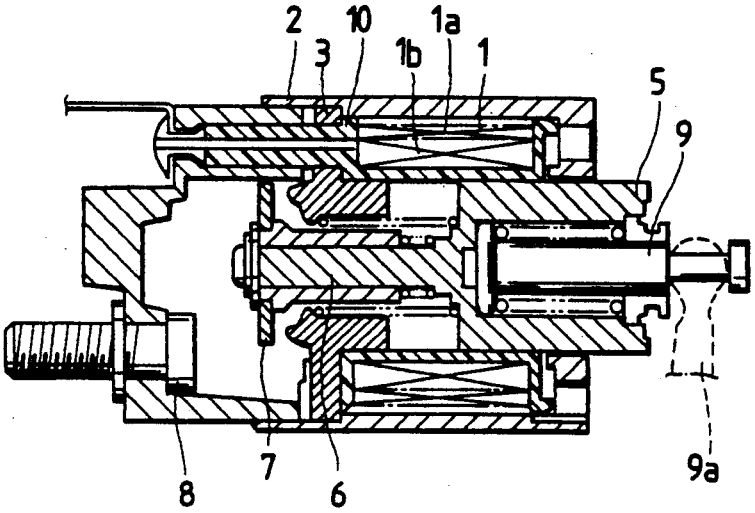
FIG. 3 is a sectional view showing an electromagnetic switch.
Figure 4A:
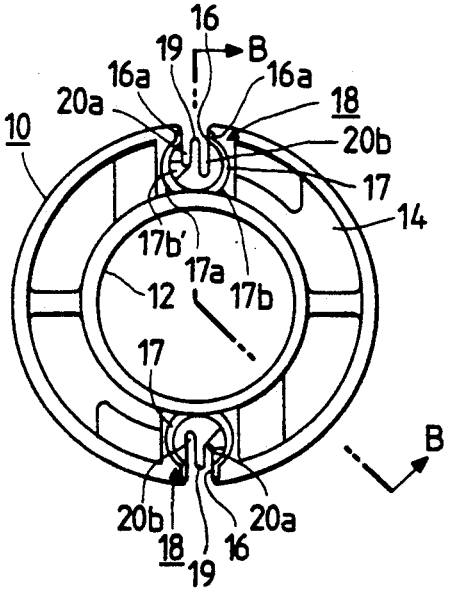
FIG. 4(*a*) is a right side view showing an example of a conventional solenoid coil bobbin for an electromagnetic switch.
Figure 4B:
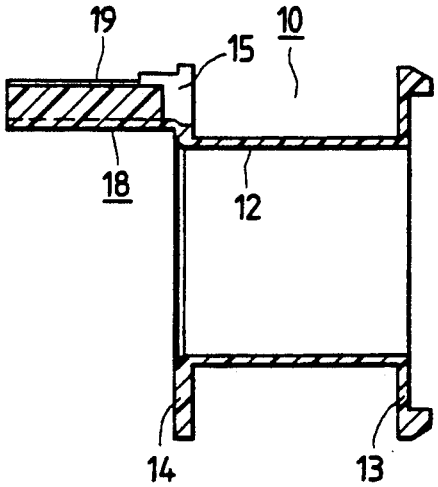
Figure 5:
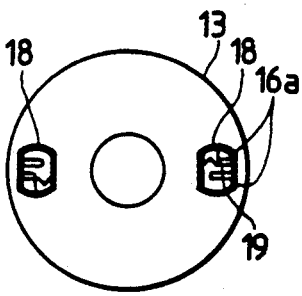
FIG. 5 is a side view showing a rigid iron coil fixed a solenoid coil bobbin.

Furthermore, a circumferential surface of the inner part 37*a* is provided with a projection 50 inclined toward the line opening 36 at an angle and having a swollen portion 51 on a top edge thereof. The swollen portion is set so as to protrude some length within a wall 3*a* of the rigid iron core 3, so that the swollen portion 51 contacts the wall 3*a* of the rigid iron core and causes the projection 50 to bend toward the inside of the grooves 40*a* and 40*b* when inserting the lead wire element 38 into the wall 3*a* of the rigid iron core. As a result, the opening 36 of the lead wire element 38 is closed, as shown in FIG. 2. Preferably, the shape of the wall 3*a* is circular.

With the above structure, after putting the lead wires in the lead wire element 38 of the bobbin 30, the lead wire element is inserted in the wall 3*a* of the rigid iron coil 3. At the time, the projection 50 on the inner portion 37*a* of the outer circumferential wall is bent toward the inside of the grooves, and the swollen portions 51 are contained in the wall 3*a* in a contact state with each other, so as to insulated between the coil winding and the rigid iron core.

The shape of the swollen portion is preferably a funnel shape so as to permit easy insertion of the lead wire part 38 into the wall 3*a* of the rigid iron coil 3.

What is claimed is:

1. A solenoid coil bobbin for an electromagnetic switch which has at least one lead wire element inserted into a rigid iron core of said electromagnetic switch, said coil bobbin comprising:

a cylindrical part having flanges disposed at either end, for receiving a coil;

notches provided on a circumferential portion of one of said flanges for the insertion of lead wires, and for connection to said lead wire element;

a pair of grooves provided in said lead wire element;

projections disposed on the outside walls of said grooves; and enlarged portions provided at top edges of said projections, respectively, and protruded from a main body of said lead wire element, said enlarged portions and said projections being bent into said grooves to close openings of said grooves when said lead wire element is inserted into said rigid iron core.

2. A solenoid coil bobbin according to claim 1, wherein the sectional shape of an insertion opening of said iron core is a circle.

3. A solenoid coil bobbin according to claim 1, wherein a sectional shape of said enlarged portion is a funnel shape.

* * * * *